US006943785B2

(12) United States Patent
Chou et al.

(10) Patent No.: US 6,943,785 B2
(45) Date of Patent: Sep. 13, 2005

(54) PIEZOELECTRIC TRANSFORMATION DRIVING APPARATUS

(75) Inventors: Chin-Wen Chou, Hsin-Tien (TW); Eddie Cheng, Hsin-Tien (TW)

(73) Assignee: Zippy Technology Corp., Taipei Hsien (TW)

( * ) Notice: Subject to any disclaimer, the term of this patent is extended or adjusted under 35 U.S.C. 154(b) by 274 days.

(21) Appl. No.: 10/298,052

(22) Filed: Nov. 18, 2002

(65) Prior Publication Data

US 2004/0095341 A1 May 20, 2004

(51) Int. Cl.[7] ..... H05B 37/02

(52) U.S. Cl. ..... 345/204; 345/211; 310/311; 310/316.01; 310/317; 310/318; 315/55; 315/307

(58) Field of Search ..... 345/204, 211, 345/208, 213; 310/311, 317, 316.01, 318; 315/55, 307

(56) References Cited

U.S. PATENT DOCUMENTS

| | | | | | |
|---|---|---|---|---|---|
| 3,707,636 | A | * | 12/1972 | Inoue | 310/318 |
| 5,341,061 | A | * | 8/1994 | Zaitsu | 310/318 |
| 5,736,807 | A | * | 4/1998 | Hakamata et al. | 310/359 |
| 6,075,325 | A | * | 6/2000 | Kouno et al. | 315/307 |
| 6,278,226 | B1 | * | 8/2001 | Danov et al. | 310/359 |
| 6,724,126 | B2 | * | 4/2004 | Chou | 310/318 |
| 2001/0035698 | A1 | * | 11/2001 | Nakatsuka et al. | 310/318 |

* cited by examiner

*Primary Examiner*—Richard Hjerpe
*Assistant Examiner*—Alexander S. Beck
(74) *Attorney, Agent, or Firm*—Birch, Stewart, Kolasch & Birch, LLP

(57) ABSTRACT

A piezoelectric transformation driving apparatus for driving elements or products to be driven by a high or a low voltage includes a driving module consisting of a pulse-width modulation (PWM) control unit and a single driving unit. The driving module outputs driving signals of the same phase and the same frequency to drive a plurality of transformation units, a plurality of piezoelectric units and a plurality of loads.

9 Claims, 3 Drawing Sheets

PIEZOELECTRIC TRANSFORMATION DRIVING APPARATUS

FIELD OF THE INVENTION

The present invention relates to a piezoelectric transformation driving apparatus and particularly an apparatus that uses a single pulse-width modulation (PWM) control unit and a single driving unit to drive a plurality of transformation units, piezoelectric units and loads.

BACKGROUND OF THE INVENTION

The light source of liquid crystal display (LCD) screens that are now being commonly used on desktop and notebook computers, PDAs, and Webpads is generated by a cold cathode fluorescent lamp (CCFL) actuated by a driving unit under a high voltage that projects light to a back panel so that displaying pictures become visible to users.

The LCD TV or LCD screen with a membrane touch screen requires a greater illumination to compensate visual requirements. The general driving device for actuating the CCFL as shown in FIG. 1 usually uses one PWM control unit to drive one driving unit, then the driving unit drives the transformer and load (CCFL). The CCFL is ignited by a high voltage. A greater current will generate a greater illumination.

When the illumination and evenness of the back light is not sufficient, a plurality of lamps are needed. To meet this requirement, the number of the PWM control unit for driving the ignition, driving unit, and transformer also increases. As a result, the size of the circuit board becomes larger, and manufacturing is more difficult and the cost increases.

SUMMARY OF THE INVENTION

Therefore the primary object of the invention is to resolve the aforesaid disadvantages. The invention employs a single PWM control unit and a single driving unit to drive a plurality of transformation units, piezoelectric units and loads to reduce the number of elements, shrink the circuit board, and simplify the manufacturing process and reduce the cost.

In order to achieve the foregoing object, the piezoelectric transformation driving apparatus of the invention includes a driving module consisting of a PWM control unit and a single driving unit to output driving signals of the same phase and same frequency to drive a plurality of transformation units, piezoelectric units and loads to operate.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
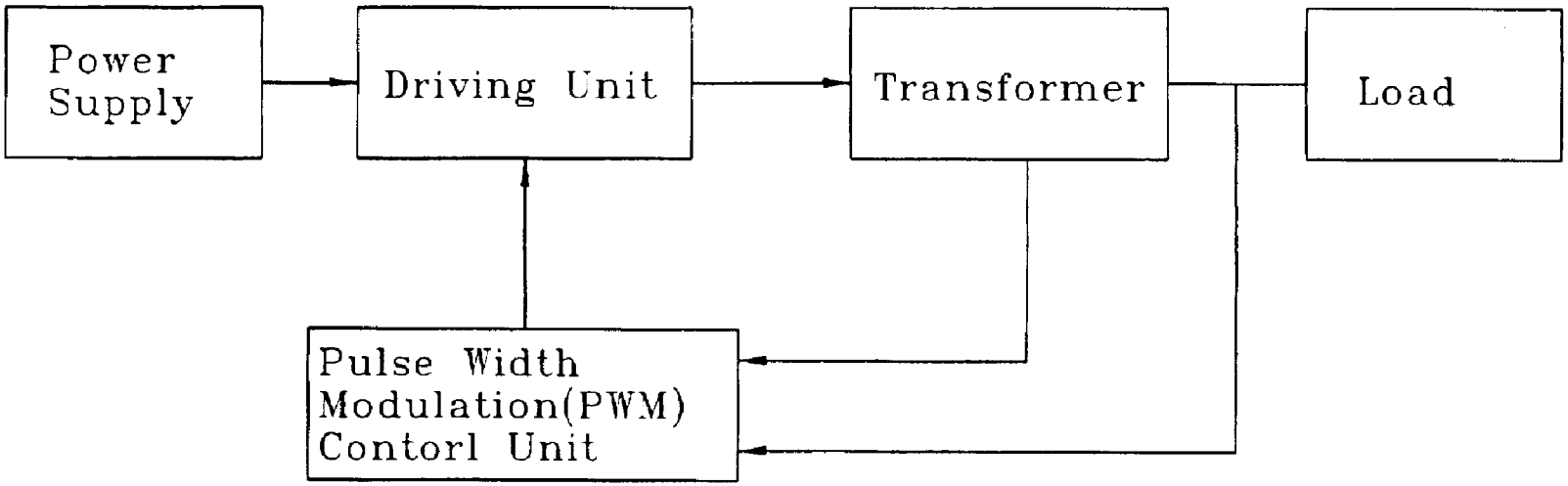
Fig.1 PRIOR ART
FIG. 1 is a circuit diagram of a conventional CCFL driving apparatus.
Figure 2:
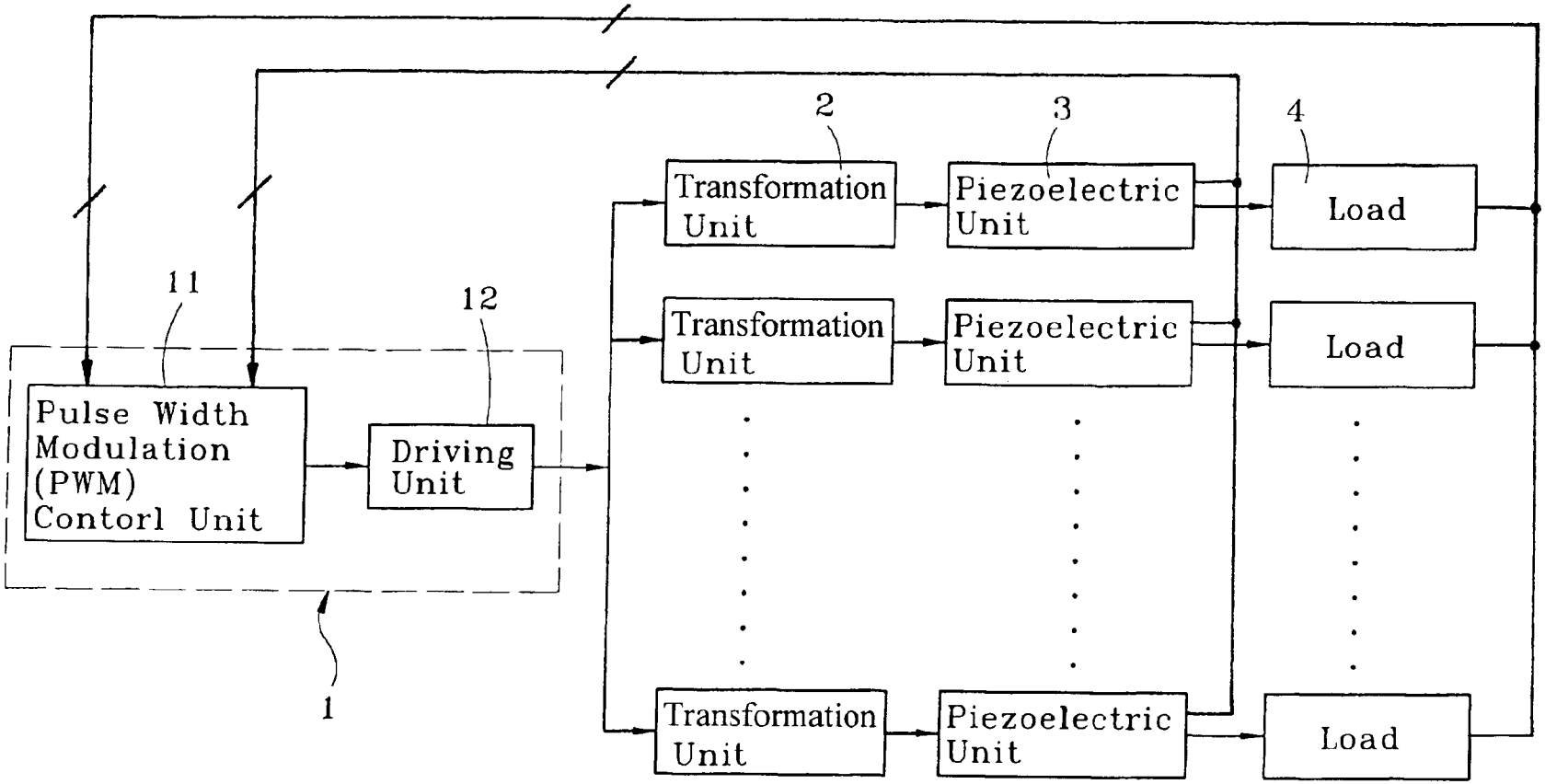
FIG. 2 is a block diagram of a first embodiment of the invention.

Refer to FIG. 2 for a first embodiment of the invention. The piezoelectric transformation driving apparatus of the invention is adopted for use on elements or products to be driven by a high voltage or a low voltage. The apparatus consists of a driving module 1, a plurality of transformation units 2 connecting to the driving module 1 and being driven synchronously by the same, a plurality of piezoelectric units 3 connecting to the transformation units 2 and being driven synchronously by the same, and a plurality of loads 4 connecting to the piezoelectric units 3 and being driven synchronously by the same. The driving module 1 generates a driving signal output that has the same phase and same frequency to drive the transformation units 2, piezoelectric units 3 and loads 4 to operate simultaneously. Thus the number of elements decreases, the circuit board may be shrunk, the manufacturing process may be simplified and the cost may be reduced.

The driving module 1 consists of a PWM control unit 11 and a single driving unit 12. The PWM control unit 11 an output driving signal of the same phase and same frequency to drive the driving unit 12. The driving unit 12 consists of metal-oxide semiconductor (MOS) elements to generate a driving signal output after having received the driving signal of the same phase and same frequency output from the PWM control unit 11.

Each of the transformation units 2 includes an inductance for transforming signals output by the driving module 1.

Each of the piezoelectric units 3 includes a single laminate or multi-laminate piezoelectric sheet or a transformer for boosting or lowering voltage output, and connects a voltage feeding back to the PWM control unit 11. Each load 4 also connects a current feeding back to the PWM control unit It so that the PWM control unit 11 can detect the current of the load 4 to control the average current of the load 4.

The loads 4 are elements or products to be driven by a high or a low voltage such as CCFLs, ozone generators, negative ions generators, or the like.

When the driving module 1 is activated by an external power supply, the PWM control unit 11 outputs a driving signal of the same phase and same frequency to actuate the driving unit 12, the actuated driving unit 12 generates driving signals which are transformed by the transformation units 2, then drive the piezoelectric units 3; then each piezoelectric unit 3 drives one load 4 to operate. Meanwhile, the load 4 connects a current feeding back to the PWM control unit 11 which detects the current of the load 4 and controls the average current of the load 4 so that the load 4 is driven evenly.

Figure 3:
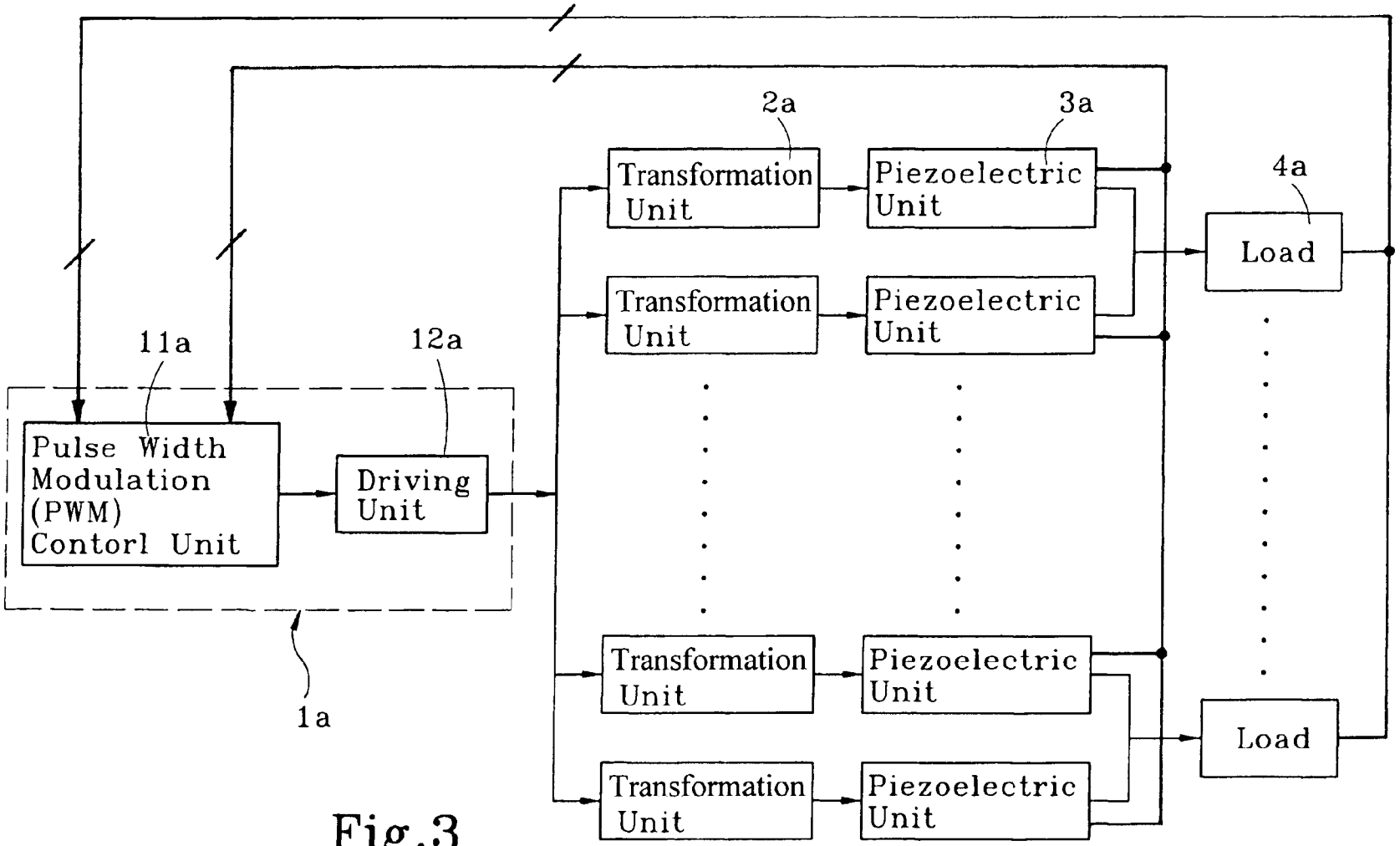
FIG. 3 is a block diagram of a second embodiment of the invention.

Refer to FIG. 3 for a second embodiment of the invention. It is substantially like the first embodiment set forth above. The differences are that after the single PWM control unit 11*a* of the driving module 1*a* drove the single driving unit 12*a*, two paths of transformation units 2*a* and piezoelectric units 3*a* are coupled to drive a single load 4*a*. Meanwhile, the two piezoelectric units 3*a* output a pair of voltages of opposite phases to the load 4*a* so that output current is more even and a greater power output and an improved matching impedance may be obtained. The single PWM control unit 11*a* can drive a plurality of loads 4*a* simultaneously.

What is claimed is:

1. A piezoelectric transformation driving apparatus for driving elements or products to be driven by a high or a low voltage, comprising:

a driving module for generating a driving signal;

a plurality of transformation units connected to the driving module, the driving signal being received by the transformation units, the transformation units being driven by the driving signal;

a plurality of piezoelectric units connected to the transformation units and being driven by signals outputted by the transformation units; and a plurality of loads connecting to the piezoelectric units and being driven by signals outputted by the piezoelectric units;

wherein the driving module synchronously drives the transformation units, the piezoelectric units and the loads.

2. The piezoelectric transformation driving apparatus of claim 1, wherein the driving module consists of a single pulse-width modulation (PWM) control unit and a single driving unit.

3. The piezoelectric transformation driving apparatus of claim 2, wherein the PWM control unit outputs signals of a same phase and a same frequency.

4. The piezoelectric transformation driving apparatus of claim 2, wherein the driving unit consists of metal-oxide semiconductor (MOS) elements.

5. The piezoelectric transformation driving apparatus of claim 1, wherein each of the piezoelectric units includes one of a single laminate piezoelectric sheet and a multi-laminate piezoelectric sheet.

6. The piezoelectric transformation driving apparatus of claim 1, wherein the transformation units include inductance.

7. The piezoelectric transformation driving apparatus of claim 1, wherein the elements to be driven by a high voltage are selected from the group consisting of cold cathode fluorescent lamps, ozone generators or negative ions generators.

8. A piezoelectric transformation driving apparatus for driving elements or products to be driven by a high or a low voltage, comprising:

a driving module for generating a driving signal;

a plurality of transformation units connected to the driving module, the driving signal being received by the transformation units, the transformation units being driven by the driving;

a plurality of piezoelectric units connected to the transformation units and being driven by signals outputted by the transformation units; and a plurality of loads connected to the piezoelectric units and being driven by signals outputted by the piezoelectric units;

wherein the driving module drives two paths of the transformation units and the piezoelectric units to drive a single load.

9. The piezoelectric transformation driving apparatus of claim 8, wherein the two piezoelectric units output a pair of voltages of opposite phases to the load.

* * * * *